United States Patent [19]

Hettinger

[11] 4,094,159

[45] June 13, 1978

[54] SUBMERSIBLE CHAMBER

[75] Inventor: Frederic L. Hettinger, Jupiter, Fla.

[73] Assignee: Perry Oceanographics, Inc., Riviera Beach, Fla.

[21] Appl. No.: 694,833

[22] Filed: Jun. 10, 1976

[51] Int. Cl.[2] ..... B63C 11/40

[52] U.S. Cl. ..... 61/69 R; 166/0.5

[58] Field of Search ..... 61/69, 86, 87, 90, 91, 61/92, 107; 166/0.5, 0.6

[56] References Cited

U.S. PATENT DOCUMENTS

| | | | |
|---|---|---|---|
| 3,186,487 | 6/1965 | Geer et al. | 166/0.5 |
| 3,568,454 | 3/1971 | Itami | 61/69 R |
| 3,641,776 | 2/1972 | Diamond | 61/69 R |
| 3,851,491 | 12/1974 | Mason | 61/69 R |

*Primary Examiner*—Paul R. Gilliam
*Assistant Examiner*—David H. Corbin
*Attorney, Agent, or Firm*—Spencer & Kaye

[57] ABSTRACT

Diving apparatus which includes a bell assembly normally negatively buoyant and including a bell. There are frame means movable vertically beneath the sea surface. Such frame means are movable between an upper position and a lower position above the subsea surface and at which the frame means can be made temporarily stationary. Bell moving means are connected between the bell assembly and the frame means for moving the bell between a lower position adjacent the subsea surface and an upper position adjacent the frame means.

9 Claims, 4 Drawing Figures

SUBMERSIBLE CHAMBER

BACKGROUND OF THE INVENTION

This invention relates to an arrangement for service, maintenance and installation at subsea locations by means of which an operator or diver can be located within a bell and from the interior of the bell operate devices for working at depths within the sea, for example, on wells in offshore petroleum recovery arrangements.

More and more in recent years there has been an increase in offshore gas and petroleum well drilling and recovery and interest increases more and more both in terms of the area where such drilling can occur and the water depths at which these can occur.

Methods had orginally been used at shallower depths where divers of various types within the water could provide the maintenance and manipulation and connecting steps necessary during preparation of a well. However, this provides severe limits on the time within which a diver may operate and causes considerable mental and physiological strain on the diver.

Therefore, automatic or remote or robot devices have been used in order to avoid the need for divers, they being controlled from the surface. However, it is important that man be located at the place where maintenance and construction or fabrication is being performed so as to deal with any trouble areas that occur and also to better analyze the situation.

This has led in most recent years to the use of manned bells, preferably atmospheric type, so that decompression is not a problem that needs to be contended with, since it creates problems even when saturation diving is used and also creates enormous expenses.

Apparatus is disclosed in U.S. Pat. No. 3,302,709 for working at an underwater well base. This arrangement provides for automatic devices which use guide lines from a surface location to the subsea well for directing the devices.

A salvaging method is disclosed in U.S. Pat. No. 1,469,574 which includes the use of parallel spaced apart guide rods extending from a salvaging ship to a sunken vessel and along which a frame is guided from the surface to the sunken vessel. The frame has the salvaging mechanism such as locating, cutting, and grappling mechanisms mounted thereon.

A diver controlled salvage bell is disclosed in U.S. Pat. No. 2,320,696, from which the operator within the bell may control movement of the bell with respect to a sunken ship and the diver may, for example, move the device laterally or vertically to position it while it is under water.

U.S. Pat. No. 3,851,491 discloses an underwater bell chamber provided with arms and grippers. The bell is guided along the guide wires from the surface to the subsea well by moving along the guide wires. The grippers are controlled by an operator within the chamber in order to stop and lock movement of the chamber by gripping the guide wires.

SUMMARY OF THE INVENTION

It is an object of the present invention to provide an improved manned submersible bell arrangement from which operators within the bell can view and operate upon devices located at the subsea surface.

The present invention provides a bell assembly which is normally negatively buoyant and which includes a bell. Frame means are provided which are movable vertically beneath the sea surface between an upward position and a lower position, the latter being above the subsea surface and at which the frame can be temporarily made stationary. Bell moving means are further provided and connected between the bell assembly and the frame means. The bell moving means is used to move the bell between a lower position adjacent the subsea surface and an upper position adjacent the frame means.

In the more detailed aspects of the present invention a blowout preventer is arranged at the subsea bed or surface and is surrounded by a frame constructed of four vertical members which may be one-piece members or may be a number of members coupled together by flanges at the ends thereof. Guide wires project from each of the vertical members to the surface. A sliding framework is provided and winched from the surface to the guide frame and back up again. The bell assembly is connected to the sliding framework. The sliding framework is connected to two adjacent guide wires and has an offset portion from which the bell depends so as to provide that the bell can be lowered to a vertical position below the top of the guide frame.

Initially, the bell which is normally buoyant and the ballast weight connected to the bottom of it in a movable manner are winched securely and compactly against one another adjacent the sliding framework. This assembly is then lowered down two of the existing guide wires and is landed on the guide frame. The surface operator then slacks off on the combined lift line/umbilical. To avoid excessive strain on the guide wires the entire assembly is designed to be near neutral buoyancy.

Upon landing on the guide frame the operator inside of the bell actuates the ballast weight winch which lowers the negatively buoyant bell/ballast weight combination to the subsea surface or sea bed. When the bottom is reached the bell operator actuates the bell winch permitting the buoyant bell to be adjusted to any desired vertical position between the bottom at which the bell ballast is located and the upper position at which is located the winch mounted on the lower end of the sliding framework.

The manipulative movement and the slide wire framework geometry are such that it is possible for the bell operator to reach any point on the blowout preventer face for servicing. If another surface of the blowout preventer requires servicing, then the framework would be raised to the surface and lowered along the two pertinent adjacent guide wires for the particular surface of the blowout preventer to be operated on.

DESCRIPTION OF THE PREFERRED EMBODIMENTS

Figure 1:
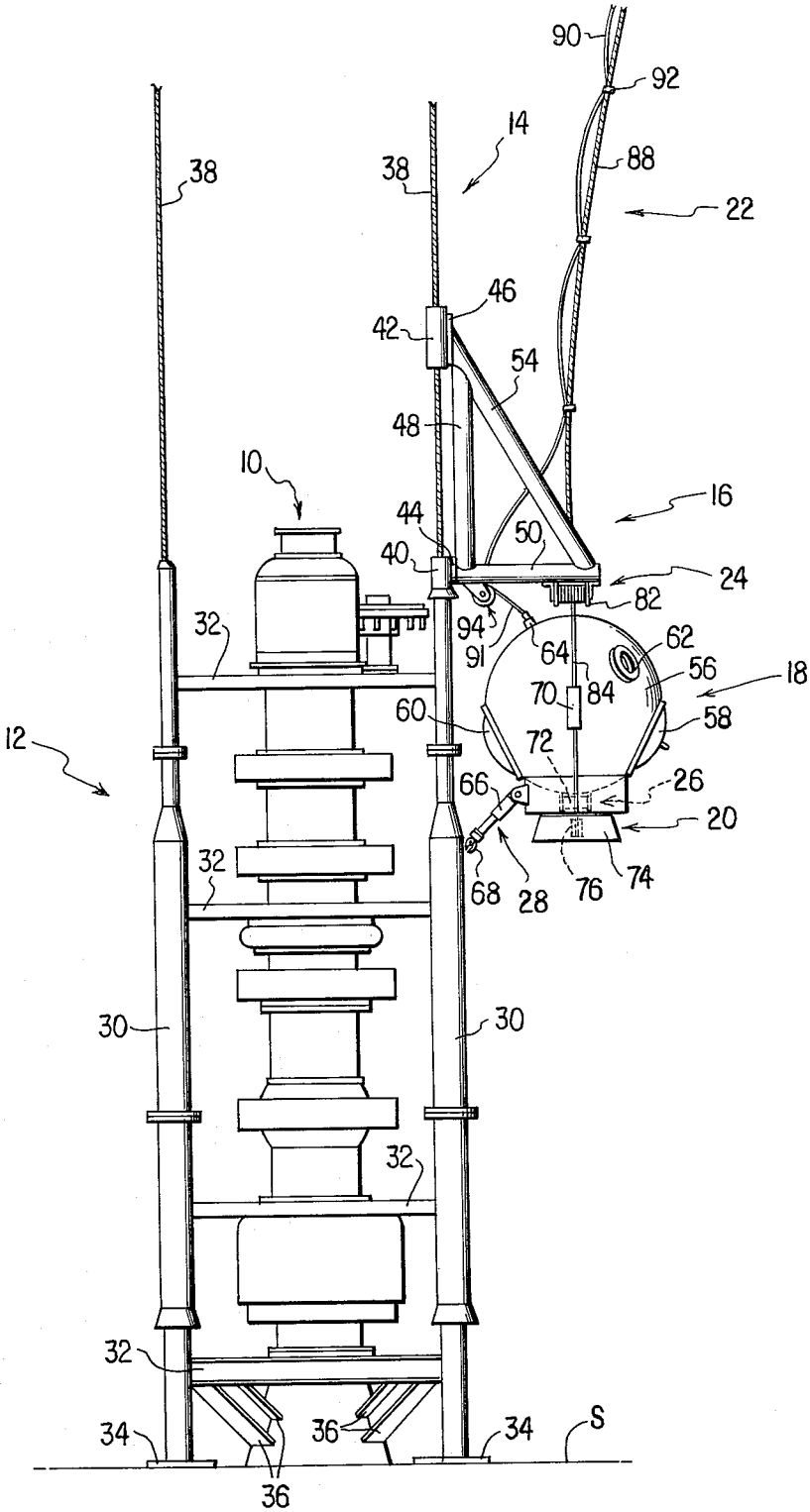
FIG. 1 is a side elevational view illustrating the bell assembly in a first position with respect to a BOP near the subsea surface.

In FIG. 1, there is generally indicated a blowout preventer (BOP) 10, which is used during drilling to control pressures and it is seated at the subsea surface S in an arrangement which is known in the art. Blowout preventers are standard in this art and generally include elements for closing around the operating tools to seal against high pressure and have a series of valves to allow for control. BOP 10 is surrounded by a guide generally indicated at 12 which includes four vertical rigid guide members 30 arranged at the corners of a square to surround BOP 10. The frame includes cross members 32 and, at least at the lower end, is attached to the BOP at 36 for stability.

An assembly of guide wires 14 is provided from the sea surface down to the BOP guide 12, one guide wire for each vertical element of the guide, so as to provide guiding means for the transportation from the sea surface to the BOP 10 and back up again for the installation and maintenance of equipment which are needed during drilling.

A sliding framework generally indicated at 16 is provided on two adjacent guide wires 14. The bell 18 is connected to the sliding framework 16 in a manner which will be described in more detail below.

The sliding framework 16 is lowered down the two adjacent guide wires and is provided with horizontally extending portions from which the bell 18 depends so that bell 18 is located outside of the square defined by connecting the imaginary lines between the four guide wires. The bell 18 is normally buoyant, that is, has positive buoyancy, and is provided with a ballast weight 20 which, together with bell 18, comprises the bell assembly. The bell assembly 18, 20 is winched securely and compactly against sliding framework 16 at the sea surface. This assembly is then lowered down two of the existing guide wires and landed on top of the guide 12. The surface operator at this time slacks off on the combined lift line/umbilical 22. To avoid excessive strain on the guide wires, the entire bell assembly is designed to be near neutral but negatively buoyant.

Figure 2:
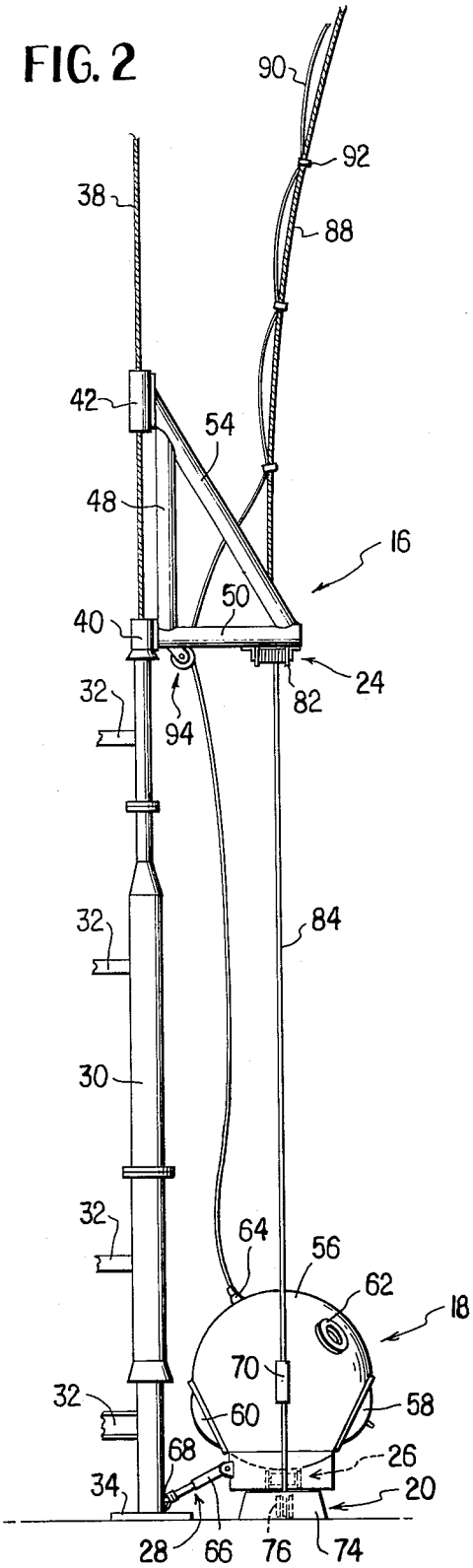
FIG. 2 is a side elevational view similar to FIG. 1 illustrating the bell at the subsea surface.
Figure 3:
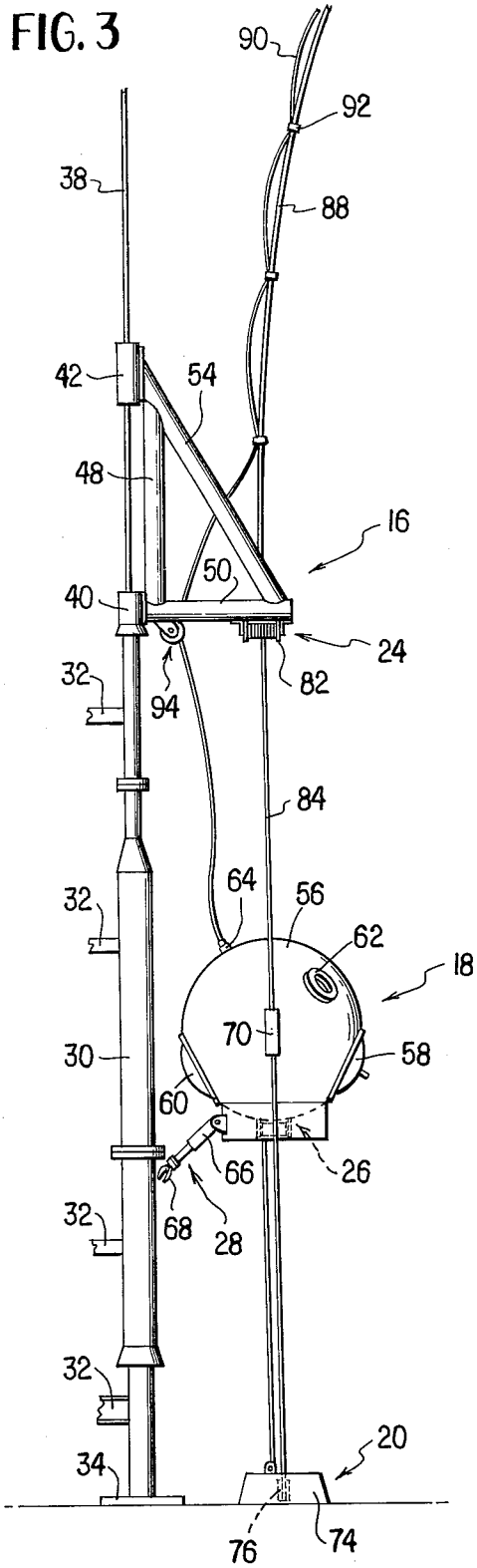
FIG. 3 is a side elevational view similar to the previous figures illustrating the bell in a position between the subsea surface and the sliding framework.
Figure 4:
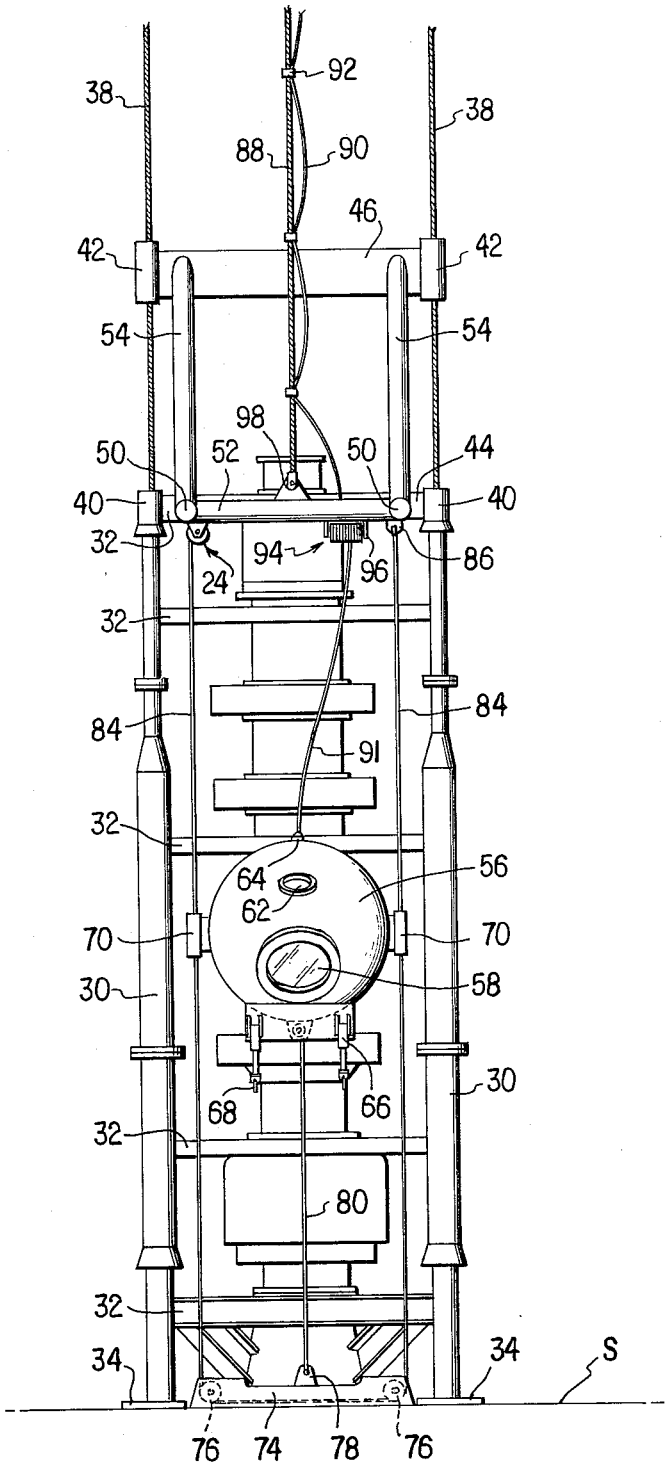
FIG. 4 is a front elevational view with the bell shown in the same position as in FIG. 3.

Upon landing on the guide 12, the bell operator actuates the ballast weight winch 24 to lower the negatively buoyant bell 18/ballast weight 20 assembly to the subsea surface as shown in FIG. 2. Once attaining the bottom, the bell operator actuates the bell winch 26 to permit the buoyant bell 18 to be adjusted to any desired vertical location between the subsea surface and the bottom end of the sliding framework as shown in FIGS. 3 and 4. A manipulator device 28 is provided on the side of the bell 18 facing the BOP 10 in order to permit the operator to operate and make adjustments and the like to the equipment.

Now that the device in general has been described, a more detailed description of the construction and operation of the various elements thereof will be provided.

A guide system is provided containing a guide structure 12 at the bottom and which surrounds the BOP 10, as well as the guide wires 14 attached to the top of the guide 12 which sits on the bottom and surrounds the BOP. This guide system includes vertical guide members 30 which can be of one piece but, for convenience, might also be constructed in sections as shown so that they can be constructed of any length desired depending upon the structure which they are to surround. Between adjacent vertical guide supports 30 are a plurality of horizontal guide struts 32 to provide rigidity to the structure which is basically a framework. Pads 34 are provided at the lower end of the vertical supports 30 to provide for a distribution of the downward pressure on the sea bed and prevent the guides 30 from sinking into the sea bed. Support struts 36 are connected between the lower end of the BOP and the guide 12 in order to provide further support to both structures which are thereby connected together.

The guide wire system 14 includes four guide wires 38, each of which is connected to a respective vertical support 30 of the guide structure and which extends to the surface in a manner which is known in the art. These four guide wires 38 are connected to the frame structure 12 in a suitable manner and provide a guide system for allowing various devices, machinery and equipment to be raised and lowered in connection with the well drilling operation.

A sliding framework 16 is provided for movement on two adjacent guide wires 38 and this sliding framework 16 is constructed in the following manner. It includes two lower sliding guides 40 and two upper sliding guides 42 which can move over the guide wires 38. The guide wires 38 slip through the guides 40, 42 upon movement of the sliding framework 16. The lower sliding guides 40 are connected together by a lower cross beam 44 and the upper sliding guides 42 are connected together by an upper cross beam 46. Between each end of the cross beams is connected a vertical strut 48 arranged parallel to the guide wires 38 and located adjacent the vertically aligned sliding guides 40, 42 for each guide wire. Thus, a rectangular frame is formed for structural strength. The frame further includes an outwardly extending horizontal offset strut 50 extending laterally from lower cross beam 44 connected between the lower sliding guides 40. These offset struts 50 project outwardly from the horizontal lower cross beam 44 from a position adjacent the lower sliding guides 40. At the outer ends thereof the offset struts 50 are connected together by a crosspiece 52 thereby providing a rectangular horizontal framework, also for rigidity. Thus, there has been described a vertical framework including members 44, 46, and 48 and a horizontal framework including the members 44, 50, and 52. In addition, there are inclined supports 54 connected at each side of the device and between the upper horizontal cross beam 46, connected between the upper sliding guides 42, and the outer ends of offset struts 50 thereby providing a diagonally arranged rectangular supporting structure comprised of struts 46, 52 and 54.

The offset struts 50 are of sufficient length to provide sufficient lateral placement of bell 18 that it can ascend and descend without interference with the crosspieces 32 between the vertical supports 30 of the subsea guide 12.

The bell 18 itself is actually a manned atmospheric chamber which is lowered from a surface vessel. It is intended to be operated at atmospheric pressure although other uses may be made of the device. The bell is provided with a life support system which is self-contained for emergencies. The life support is provided from the surface by means of the umbilical 90. The bell chamber, its construction, operation, life support systems and the like, as well as the assemblies related thereto, can be the type of structures disclosed in U.S. Pat. No. 3,851,491.

The bell is constructed so that it is buoyant, that is, has a positive buoyancy, so that if unconnected to other equipment it moves upwardly toward the sea surface. The bell itself includes an outer shell 56 having a hatch 58 for ingress and egress to the life support and working chamber. This hatch 58 can be provided with a window for observation if desired. An actual observation window 60 is provided on the side of the bell which faces the BOP and other such windows can be provided at multiple locations such as at port 62. A penetrator 64 is provided to which the umbilical portion 91 is connected in order to provide air, electrical connections and communication means as well as other types of information and signals which are needed from the bell to the surface during operation, ascent and descent.

In addition to providing for voice communication, the umbilical provides for television communication and for the sensors and gauges in the bell to transmit indications to the surface so that some of the controls can be operated and maintained and continuous surveillance performed from the surface. The side of the bell facing the BOP is provided with manipulators 28 including extendible manipulating arms 66 pivotally connected to the bell and extensible and rotatable and may have, for example, claw-like grippers 68 at the ends thereof which can grip tools, valves and the like and which can be rotated longitudinally of the arms 66. They can be moved up and down and from side to side. Thus, a complete range of movement is provided for the manipulators 28 so that an operator within the bell chamber can provide maintenance and operation of various devices outside of the bell and located within the guide frame 12 and on the BOP.

The outside of the bell 56 is provided with sliding bell guides 70 for a purpose which will be explained in more detail later. The bell itself is provided at the lower end thereof with a chamber in which is located a winch 72 for a purpose which will also be described below.

There is a ballast weight arrangement 20 which includes a ballast weight 74 which is at least sufficiently heavy to overcome the positive buoyancy of the bell and render it negatively buoyant when the bell and the ballast weight are considered together. The exact amount of this weight needs to be determined for the particular application but should be sufficient so that when the ballast is lowered it will be maintained steady on the subsea surface and will maintain bell guide wires 84 connected with it taut as required and as described further below.

The ballast 74 itself is constructed in such a manner as to include idler rollers or sheaves 76 over which a bell guide wire 84 operates and therefore the idler rollers 76 are easily rotatable. A lifting flange 78 is connected to the ballast 74 by which the ballast is connected to a bell ascent/descent cable 80 which is connected from flange 78 to bell winch 72. The bell winch itself includes a motor and a drum onto which the bell ascent/descent cable 80 is wound or unwound depending upon the direction of rotation of the motor. It should be clear that as the winding process takes place the ballast weight and the bell are moved closer together until they are in the position shown in FIG. 1, at which time the ballast weight is immediately adjacent the bottom of the bell and contacting it. When winch 72 is unwound, the bell and the ballast weight are separated as shown, for example, in FIGS. 3 and 4 in which the ballast weight is located on the subsea surface S and the bell itself has ascended halfway to the sliding framework 16.

The ballast weight winch 24 is connected to the lower end of the sliding framework 16 and includes a motor driven drum 82 onto which the bell guide cable 84 is wound. One end of the bell guide cable is connected at 86 to one side of the sliding framework 16 and the other end to the winch 24 at the opposite side of sliding framework 16. The bell guide cable 84 is anchored at one end at 86, passes downwardly through a first sliding guide 70 on the bell down to the ballast and around first one idler roller or sheave 76 across the ballast and then around the second idler roller or sheave 76 upwardly through the other sliding guide 70 on the bell and then to drum 82. Thus, as the drum 82 is wound or unwound the ballast will ascend or descend accordingly.

The lift line/umbilical 22 includes the umbilical itself 90 and a lift line 88 which are loosely tethered together by clamps 92 spaced periodically along the length of the lift line/umbilical. The umbilical 90 is provided with all of the fluid carrying means required for providing air from the surface to the bell and with communication means for providing voice communication, possibly television communication, and for transporting the various gauge and sensing indications as well as controls between the bell and the surface. The umbilical assembly 22 at the surface is connected to a suitable raising and lowering device such as a topside winch and is connected to the sliding framework 16.

As can be seen from FIG. 4, the umbilical 90 is connected to an umbilical winch or takeup drum 94 which includes a drum 96 onto which the umbilical is wound so as to permit slacking off and taking up slack as the bell is moved from the sliding framework 16 down to the subsea surface S where the ballast is located and back up again. Drum 96 may be spring loaded to take up slack or can be arranged to be driven. The drum 96 is provided with a fluid and an electrical slip ring arrangement so that only the umbilical section 91 between sliding framework 16 and the bell is wound on drum 96 whereas the portion of umbilical 90 above sliding framework 16 is connected to the slip ring arrangement on drum 96 and does not change length upon rotation of drum 96 as does section 91. At the same time, the lift line itself 88 is connected at 98 to the sliding framework 16.

The operation of the device will now be described.

The sliding framework 16 is lowered down the two adjacent guide wires from a topside winch. One manner of constructing and/or using a guide frame and guide wire arrangement somewhat similar to that disclosed herein is disclosed in U.S. Pat. No. 3,302,709, and a similar system is used in the arrangement disclosed in U.S. Pat. No. 3,851,491, while slightly modified arrangements are disclosed in U.S. Pat. Nos. 3,641,777, 3,353,344, and 3,465,531. The bell assembly 18, 20 is winched securely and compactly against sliding framework 16 topside at the sea surface. This assembly is then lowered down two of the existing guide wires and landed on top of the guide 12. The surface operator at this time slacks off on the combined lift line/umbilical 22. In order to avoid excessive strain on the guide wires, the entire bell assembly is designed to be near neutral.

Upon landing on the guide 12, the bell operator actuates the ballast weight winch 24 to lower the negatively buoyant bell 18/ballast weight 20 assembly to the bottom as shown in FIG. 2. Once attaining the bottom, the bell operator actuates the bell which 26 to permit the buoyant bell 18 to be adjusted to any desired vertical location between the subsea surface and the lower portion of the sliding framework 16 as shown in FIGS. 3 and 4. A manipulator device 28 of the type known in the prior art such as device 75 shown in FIGS. 2, 3, and 9–11 in U.S. Pat. No. 3,851,491, or as disclosed in U.S. Pat. Nos. 3,400,541, 3,229,656, and 3,463,226, is provided on the side of the bell 18 facing the BOP 10 in order to permit the operator to operate and make adjustments and the like to the equipment. By appropriate design of the manipulator movement and slidewire framework geometry, it is possible for the bell operator to reach any point on the BOP face for servicing.

All motors for winches and the like may be hydraulically or electrically driven and each winch may be provided with its own reversible motor.

It will be understood that the above description of the present invention is susceptible to various modifications, changes and adaptations, and the same are intended to be comprehended within the meaning and range of equivalents of the appended claims.

What is claimed is:

1. Diving apparatus comprising:

(a) a guide member system extending from a location at the seabed where work is to be performed and the sea surface and including member disposed laterally of the work location;

(b) a normally negatively buoyant bell assembly including a positively buoyant bell and a negatively buoyant ballast weight removably connected thereto;

(c) sliding frame means movable vertically along said guide member system beneath the sea surface between an upper position at the sea surface and a lower position sufficiently above the subsea surface to permit vertical movement of the bell assembly to the vicinity of the work location, the frame means being temporarily stationary at said lower position by abutment with a portion of said guide member system; and (d) bell assembly moving means connected between said bell assembly and said frame means for moving said bell assembly between a lower position adjacent the subsea surface work location and an upper position adjacent said frame means when the latter is in its lower position.

2. Diving apparatus as defined in claim 1 comprising manipulator means connected to said bell for operating upon equipment at the work location.

3. Diving apparatus as defined in claim 1 comprising means for raising and lowering the ballast weight with respect to said frame means.

4. Diving apparatus as defined in claim 3 wherein said weight raising and lowering means and said bell assembly moving means are controlled from within said bell.

5. Diving apparatus as defined in claim 3 wherein said ballast weight raising and lowering means include a cable connected between said weight and said frame means, and winch means on said frame means for taking up and paying out said cable.

6. Diving apparatus as defined in claim 5 comprising bell guide means on said bell for vertically guiding said bell along said cable toward and away from said ballast weight.

7. Diving apparatus as defined in claim 6 comprising means for raising and lowering said bell with respect to said ballast weight.

8. Diving apparatus as defined in claim 1 comprising umbilical assembly connected to said frame means for raising and lowering said frame means and thus said bell assembly and for providing fluid and electrical communication between said bell and the sea surface.

9. Diving apparatus as defined in claim 8 wherein said umbilical assembly includes a lift line connected to said frame means and an umbilical, umbilical wind up means on said frame means for taking up slack and permitting pay out of the umbilical as the bell moves vertically toward and away from said frame means.

* * * * *